US005186195A

United States Patent [19]

Wall

[11] Patent Number: 5,186,195

[45] Date of Patent: Feb. 16, 1993

[54] APPARATUS FOR RINSING CHEMICAL CONTAINERS

[76] Inventor: Bernard W. Wall, 37622 Highway 59, Yuma, Colo. 80759

[21] Appl. No.: 714,576

[22] Filed: Jun. 13, 1991

[51] Int. Cl.[5] ..... B08B 9/12

[52] U.S. Cl. ..... 134/170; 134/166 R

[58] Field of Search ..... 134/166 R, 167 R, 168 R, 134/169 R, 170, 152

[56] References Cited

U.S. PATENT DOCUMENTS

| | | | |
|---|---|---|---|
| 1,620,654 | 3/1927 | Haugen . | |
| 1,629,486 | 5/1927 | Dougherty . | |
| 1,657,072 | 1/1928 | Dougherty | 134/169 R X |
| 1,795,763 | 3/1931 | Cramer et al. . | |
| 2,105,767 | 1/1938 | Gettleman . | |
| 2,228,684 | 1/1941 | Barnum | 134/152 X |
| 2,845,934 | 8/1958 | Payson | 134/56 R |
| 3,073,325 | 1/1963 | Rebizzo et al. | 134/170 X |
| 3,121,536 | 2/1964 | McKibben | 134/168 R X |
| 3,173,433 | 3/1965 | Wynne et al. | 134/169 R X |
| 3,470,891 | 10/1969 | Ruddick | 134/57 R |
| 3,564,584 | 2/1971 | Ruddick | 134/57 R |
| 3,798,066 | 3/1974 | Evans | 134/27 |
| 4,299,245 | 11/1981 | Clapper | 134/170 X |
| 4,872,467 | 10/1989 | Ballu | 134/104.2 |
| 4,957,566 | 9/1990 | Evans et al. | 134/22.14 |
| 4,960,142 | 10/1990 | Robb et al. | 134/166 R X |

FOREIGN PATENT DOCUMENTS

| | | | |
|---|---|---|---|
| 73906 | 4/1894 | Fed. Rep. of Germany | 134/169 R |
| 209943 | 1/1924 | United Kingdom | 134/170 |

*Primary Examiner*—Philip R. Coe
*Attorney, Agent, or Firm*—John E. Reilly

[57] ABSTRACT

A portable power rinse system which can be truck-mounted and has a rinse pipe, drum support arms and nozzle mounted in off-center relation within the vessel so that a drum can be inverted into the vessel and the rinse nozzle inserted into an opening at one end of the drum and the drum tilted in different directions about the support arm for thorough flushing of the contents of the drum which are removed through a drain hose at the lower end of the vessel. A manifold with a flow control valve regulates flow of a rinsing liquid either into the rinse nozzle in the vessel or to an externally located, hand-operated spray for rinsing out the interior of the vessel as well as other smaller containers to be flushed or rinsed.

13 Claims, 1 Drawing Sheet

APPARATUS FOR RINSING CHEMICAL CONTAINERS

This invention relates to rinsing apparatus; and more particularly relates to a novel and improved method and apparatus for rinsing chemical containers, such as, those used for pesticide spraying operations.

BACKGROUND AND FIELD OF INVENTION

There is an increasing awareness of the possible hazards of indiscriminate disposal of empty containers for toxic chemical products; and, in large scale commercial operations, government regulations and standards have been established for rinsing of those containers before they can be discarded. For example, under 40 C.F.R. Ch. 1, large metal drums which contain pesticides for crop dusting or aerial spraying operations must, prior to disposal, be subjected to a triple rinsing operation. By "triple rinsing" is meant flushing of containers three times and adding the rinse liquid to the spray mixture or disposing of it by a method prescribed for disposing of the pesticide. The large metal drums or cylinders typically include a limited inlet or bung hole at the upper end and thus affords but limited access for a rinsing operation and having made it virtually impossible for one person to efficiently rinse and remove the rinsed materials from the drum and repeat this the requisite number of times.

Various proposals have been advanced to overcome the above-enumerated problems and, for example, U.S. Pat. No. 4,872,467 to P. Ballu discloses the use of a rinsing vat for small containers with a central nozzle projecting above the upper open end of the vat and a lower funnel-shaped drain. The device is activated by placing the container over the nozzle such that the weight of the drum depresses spring-loaded supporting arms to open a valve for the delivery of a rinsing liquid through the nozzle. When the weight of the drum is removed from the support arms, the valve is closed and the rinsing liquid is then directed through the lower drain of the system for flushing out the collected liquid. U.S. Pat. No. 1,795,763 to C. G. Cramer et al discloses a nozzle which is inserted into the inlet of a drum for the purpose of rinsing out its interior. U.S. Pat. No. 2,845,934 to R. C. Payson similarly discloses a rinse nozzle for cleaning out the interior of a drum and the rinse materials are removed through a suction tube associated with the nozzle. Other representative patents are U.S. Pat. Nos. 1,620,654 to O. K. Haugen, 1,629,486 and 1,657,072 to D. A. Dougherty, 2,105,767 to F. Gettelman, 3,470,891 and 3,564,584 to M. Ruddick and 3,798,066 and 4,957,566 to R. J. Evans et al.

Nevertheless, rinsing systems of the type which have been proposed for use in the past are not adequate for cleaning out larger drums used in storing pesticides in aerial spraying operations. In this relation, it is important that the drum be supported within the rinsing vessel and be capable of being tilted or manipulated to assure complete flushing of the interior of the drum and further to insure that a single individual can efficiently conduct this operation, if necessary, and to be able to dispose of the rinse liquid in a manner prescribed by law. Furthermore, it is desirable that the rinsing vessel itself be capable of being transported to the intended site of use and easily connected to a source of rinsing liquid; yet the rinsing system must be sufficiently versatile as to permit efficient rinsing of smaller containers as well as the vessel itself and to enable efficient collection of the rinsed materials either for reuse or in a suitable waste collection area.

SUMMARY OF THE INVENTION

It is therefore an object of the present invention to provide for a novel and improved apparatus for rinsing containers and particularly large-sized drums containing pesticides or other toxic materials.

Another object of the present invention is to provide for a novel and improved apparatus for cleaning drums in which the drum may be partially supported within a rinsing vessel and thoroughly rinsed with a minimum of lifting and handling required; and specifically wherein the drum can be tilted to different selected angles to assure complete rinsing of the interior.

It is a further object of the present invention to provide in a rinsing system for drums and other containers for a rinsing nozzle which will both support and rinse the drum with a minimum of handling required on the part of the operator, and further will permit selective rinsing of other containers through a separate portable hand-operated spray with a minimum of effort on the part of the operator.

It is an additional object of the present invention to provide in a rinsing system for pesticide and other toxic materials for an efficient means of flushing out the containers as well as the rinsing vessel for the containers and efficiently recovering the rinsed materials for reuse by adding to the spray mixture or otherwise disposing of it by prescribed methods.

It is a still further object of the present invention to provide for a rinsing system for flushing out the interior of large drums, which is portable and which can be easily transported to the intended sites of use and connected up to available sources of pressurized liquid for rinsing out the interior of the container and collecting the rinsed materials.

In accordance with the present invention, a power rinsing system has been devised for large containers, such as, pesticide drums and which comprises a rinsing vessel having an upper open end of a size greater than the diameter of the largest sized drums to be rinsed and a lower drain end having a drain opening therein, a rinse nozzle mounted for upward extension of off-center relation to a vertical axis of the vessel and rinsing liquid supply means connected to the nozzle to supply liquid under pressure for flushing out the interior of the container to be rinsed, and mounting means are provided for the rinsing nozzle which also serve to support the drum in an inverted position within the vessel, and the rinsing nozzle extends upwardly through an opening in the drum for complete rinsing of the interior.

In its preferred form, the rinsing vessel is designed such that it can be truck-mounted and transported to the intended site of use but is sufficiently large that large drums of the type used for commercial pesticide spraying operations and having a limited opening at one end of the drum can be inverted into the rinsing vessel and the opening placed over a rinse nozzle disposed beneath the upper open end of the vessel. The nozzle is disposed in off-center relation to the vessel such that the drum can be tilted or tipped to different angles to assure complete flushing when the rinsing fluid is discharged through the rinsing nozzle; and further the vessel will facilitate draining of the rinsed materials from the vessel into a separate collection area. A manifold is provided with a flow control valve to regulate or distribute the rinsing liquid either into the rinsing nozzle within the vessel or an externally located hand-operated spray for rinsing out the vessel itself as well as smaller containers.

The above and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

Figure 1:
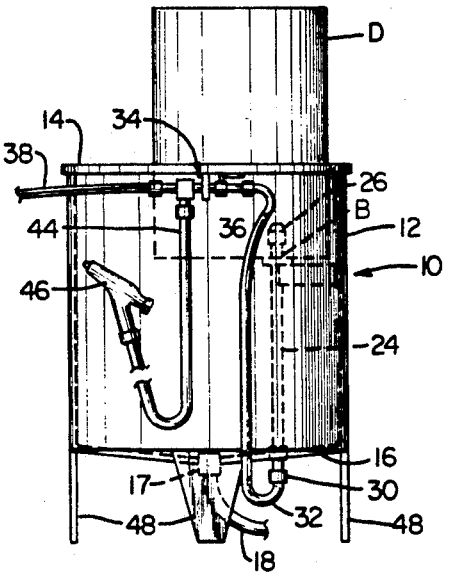
FIG. 1 is a front view in elevation of a preferred form of the present invention illustrating a drum to be cleaned inverted over a rinse nozzle within the rinse vessel of the present invention.
Figure 2:
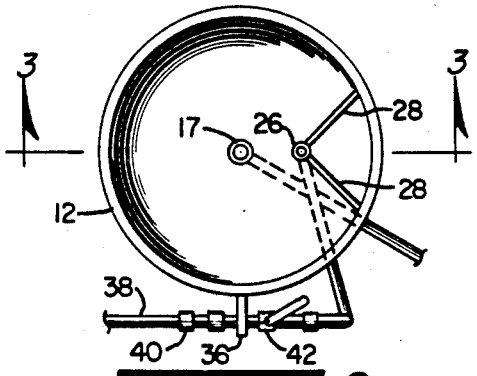
FIG. 2 is a top plan view of the system shown in FIG. 1.
Figure 3:
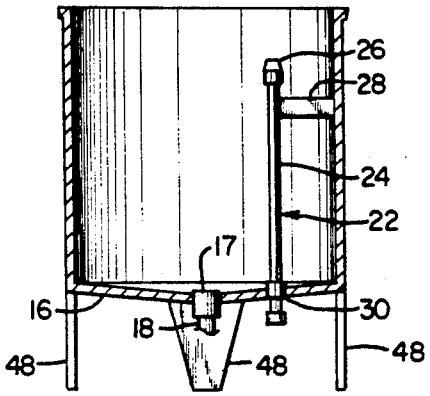
FIG. 3 is a cross-sectional view taken about lines 3—3 of FIG. 2.

Referring in more detail to the drawings, there is shown in FIGS. 1 to 4 a preferred form of rinsing apparatus 10 and which is broadly comprised of a generally cylindrical vessel 12 having an upper open end 14 and a bottom wall 16 inclining downwardly into a central opening 17 with a drain hose 18 extending downwardly away from the opening 17.

A rinse pipe 22 includes a riser portion 24 terminating in an upper nozzle 26 and supported in off-center relation to a vertical axis extending through the center of the vessel by a pair of spaced support arms 28 which extend inwardly from the inner surface of the cylindrical wall of the vessel at approximately 90° to one another. It is important in supporting the rinse pipe that the drum support means in the form of the support arms 28 also extend in off-center relation to the vat and extend between an interior surface portion of the van and one side of said riser nearest the interior surface portion whereby the drum can rest on the drum support means and be tilted or tipped at different angles in a manner to be described. The support arms 28 are fixed rigidly to the riser 24, and the lower end of the riser is connected to a fitting 30. The fitting 30 is in turn attached to a hose 32 extending from a manifold 34 on the external surface of the vessel.

The manifold 34 is supported by a bracket 36 to the upper end of the vessel, there being a rinse fluid supply hose 38 connected to one side of a tee 40 at the manifold, and the supply hose 32 extending from the opposite side of the tee 40 with a flow control valve 42 disposed in the line 32. Another flexible hose 44 extends from the stem of the tee and is provided with a hand-operated spray nozzle 46.

Figure 4:
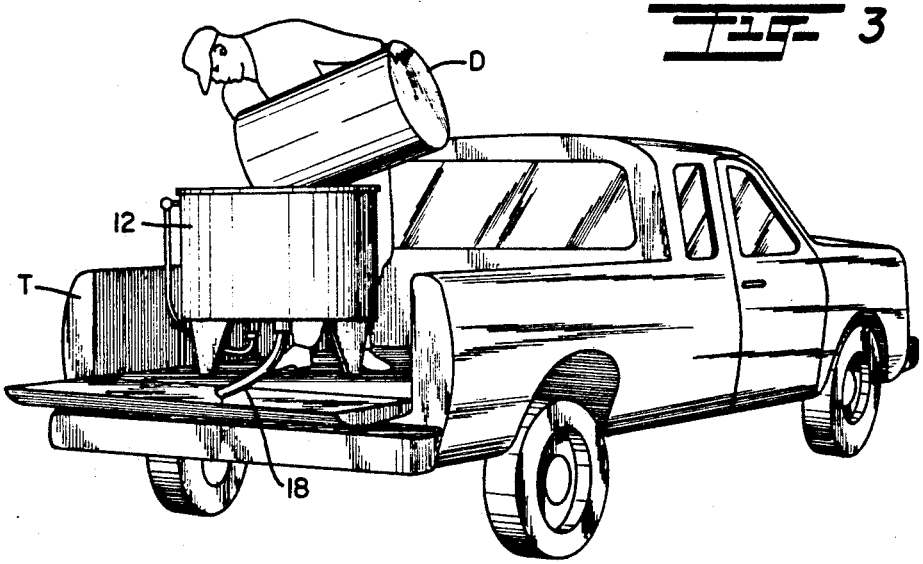
FIG. 4 is a perspective view illustrating the preferred form of rinsing system of the present invention mounted on a truck.

Preferably, the vessel 12 is supported on legs 48 extending downwardly from the bottom wall 16 at circumferentially spaced intervals. As such, the vessel is primarily intended to be used as a mobile, truck-mounted system, for example, by placing on a truck bed T, as illustrated in FIG. 4. The supply hose may be of any desired length but most desirably is of a relatively short length and provided with a fitting, not shown, to facilitate attachment to a source of supply so that the system can draw its rinsing fluid from a suitable source of water under pressure. In turn, the flow control valve 42 is intended to regulate the water pressure directed through the rinse supply line 32 to the riser pipe 24 and nozzle 26. In the alternative, when the flow control valve 42 is closed, the hand-operated spray nozzle 46 may be selectively opened to direct water under pressure into the interior of the vessel in rinsing out smaller containers or in flushing out the vessel itself.

In cleaning out larger drums, such as, a drum as designated at D having a bung hole or limited opening at one end as designated at D in FIG. 1, the drum is inverted into the vessel with the nozzle 26 extending upwardly through the bung hole, and the end of the drum D rests on the support arms 28. In this relation, the entire rinsing apparatus and particularly the vat 12 is of a height less than the waist level of the operator and of a diameter larger than the diameter of the largest sized drums to be rinsed so that each drum D can be easily tilted beneath the support arms 28 as the nozzle 26 directs a water spray under pressure into the interior of the drum. For this reason, it is important that the riser be supported beneath the upper open end 14 of the vessel so that in supporting the drum over the nozzle 36, the walls of the vessel will also cooperate in supporting the drum as it is tilted or inclined in different directions about the nozzle 36.

The rinsing system as described is acceptable for use in triple-rinsing operations in compliance with EPA regulations. Specifically, this can be accomplished by opening the flow control valve 42 with the drum D positioned over the rinsing nozzle to thoroughly rinse out the interior of the drum. The flow control valve 42 is then closed and the drum permitted to drain completely following which the operation is repeated two more times as described. At the end of the rinsing operation, the flow control valve 42 is closed and the hand-operated spray nozzle 46 can then be opened to direct a spray around the interior of the vessel 12 to completely flush any of the rinsed materials out through the drain opening 17. During the rinse operations, the material is pumped into the spraying equipment for immediate use or into a container for removal to an appropriate waste collection area.

It is therefore to be understood that while a preferred form of invention has been herein set forth and described, various modifications and changes may be made in the particular construction and arrangement of elements as well as the sequence of steps followed in the rinsing operation without departing from the spirit and scope of the present invention as defined by the appended claims.

I claim:

1. A power rinsing system for large drums comprising:

a vat having an upper open end of a size greater than the diameter of the drum to be rinsed and a lower end including a drain opening therein;

a rinse pipe disposed in said vat for upward extend in off-center relation to a vertical axis of said vat, and a nozzle at an upper end of said pipe; and rinsing fluid supply means connected to said rinsing pipe for supplying fluid under pressure through said pipe, and drum support means mounted in off-center relation to said vat for supporting said drum in inverted relation within said vat with said rinsing pipe extending upwardly through an opening in said drum and said drum extending upwardly through the upper open end of said vat, said drum support means including at least one arm member extending horizontally between an interior surface portion of said vat and one side of said pipe nearest said interior surface portion.

2. A power rinsing system according to claim 1, said support means defined by a pair of said arm members extending away from said rinsing pipe substantially at 90° to one another and in horizontal alignment with one another to mutually support a drum resting in on said arm members.

3. A power rinsing system according to claim 1, said rinsing fluid supply means including a manifold mounted on an exterior portion of said vat, a supply line extending from said manifold for connection to said rinsing pipe, and flow control valve means for controlling the supply of fluid to said rinse pipe.

4. A power rinsing system according to claim 3, said supply means including a flexible hose connected to said manifold and provided with a hand spray nozzle at one end thereof, said flow control means being movable to regulate the flow of rinsing fluid to a selected one of said rinse pipe and said hand spray nozzle.

5. A power rinsing system according to claim 1, a drain hose connected to said drain opening in said vat.

6. A power rinsing system for large drums comprising:

a vat having an upper open end of a size greater than the diameter of the drum to be rinsed and a lower funnelshaped end including a drain opening therein;

a rinsing pipe including drum support means for mounting said pipe within said vat for upward extension in off-center relation to a vertical axis of said vat, said drum support means extending between an interior surface portion of said vat and one side of said pipe nearest said interior surface portion whereby to support said drum in inverted relation within said vat such that a lower end of said drum can extend upwardly through the upper open end of said vat and be manually tilted at different angles about said support means with said pipe extending upwardly through an opening in said drum and a nozzle at the upper end of said pipe; and rinsing fluid supply means connected to said pipe for supplying water under pressure through said pipe.

7. A power rinsing system according to claim 6, said drum support means defined by a pair of arm members extending away from said pipe in circumferentially spaced relation to one another.

8. A power rinsing system according to claim 6, said supply means including a flexible hose provided with a hand spray nozzle at one end thereof and flow control means being movable to regulate the flow of rinsing liquid to a selected one of said rinsing pipe and said hand spray nozzle.

9. A truck-mounted pesticide rinsing system for triple-rinsing any residue of pesticide left in large drums of the type containing a limited inlet opening at one end of said drum, said system comprising:

a vat having base support means for supporting said vat on a truck bed, said vat having an upper open end and a lower funnel-shaped end and including a drain opening therein;

a rinsing pipe mounted in said vat for upward extension in said vat, drum support means extending between an inner surface of said vat and one side of said pipe nearest said inner surface whereby to support said drum in inverted relation within said vat with said rinsing pipe extending upwardly through the limited opening in said drum and said drum can be manually tiled at different angles about said drum support means; and rinsing liquid supply means connected to said rinsing pipe for supplying rinsing liquid under pressure therethrough into the interior of said drum, and flow control means for controlling the supply of liquid through said rinsing pipe for triple-rinsing the interior of said drum while said drum is mounted over said rinsing pipe with one edge of said drum resting on said drum support, and said flow control means connected by a flexible hose to a source of water for supplying water under pressure to said rinsing pipe.

10. A truck-mounted pesticide rinsing system according to claim 9, including a drain hose extending from said drum opening for removal of rinsed materials from said vat.

11. A truck-mounted pesticide rinsing system according to claim 9, said rinsing liquid supply means including a manifold mounted on an exterior portion of said vat, a hose extending from said manifold for connection to said rinsing pipe, and said flow control means including a flow control valve for controlling the supply of water to said rinsing pipe.

12. A truck-mounted pesticide rinsing system according to claim 9, a second flexible hose connected to said manifold having a spray nozzle at one end thereof, said flow control means movable to regulate the flow of water alternately to one of said rinsing pipe and said spray nozzle.

13. A truck-mounted pesticide rinsing system according to claim 9, said vat being of an overall height less than the waist level of an adult and a diameter of approximately one and a half times the size of the largest sized drums to be rinsed said drum support means extending from an upper end of said rinsing pipe whereby to support said drum to be rinsed in inverted relation within said vat such that said rinsing pipe will extend upwardly through an opening in said drum and said drum can be manually tilted at different angles while extending upwardly through said upper open end of said vat.

* * * * *

UNITED STATES PATENT AND TRADEMARK OFFICE

CERTIFICATE OF CORRECTION

PATENT NO. : 5,186,195

DATED : February 16, 1993

INVENTOR(S) : Bernard W. Wall

It is certified that error appears in the above-identified patent and that said Letters Patent is hereby corrected as shown below:

Column 2, line 45, cancel "of" and substitute -- in --.

Column 4, line 57 (Claim 1) cancel "extend" and substitute -- extension --.

Column 5, line 8 (Claim 2) cancel "in".

Column 5, line 28 (Claim 6) cancel "funnel/shaped" and substitute -- funnel-shaped --.

Column 6, line 14 (Claim 9) cancel "tiled" and substitute -- tilted --.

Signed and Sealed this

Ninth Day of May, 1995

Bruce Lehman

*Attest:*

BRUCE LEHMAN

*Attesting Officer*

*Commissioner of Patents and Trademarks*